United States Patent [19]

Laramore

[11] Patent Number: 4,986,805

[45] Date of Patent: Jan. 22, 1991

[54] FIREFIGHTER'S PORTABLE WATER RESERVOIR AND METHOD OF MAKING THE SAME

[75] Inventor: Michael D. Laramore, Santee, Calif.

[73] Assignee: Baldwin/Green Inc., San Diego, Calif.

[21] Appl. No.: 423,041

[22] Filed: Oct. 18, 1989

[51] Int. Cl.[5] ..... B31B 39/60; B31B 39/68; B31B 41/26

[52] U.S. Cl. ..... 493/199; 493/213; 493/214; 493/217; 493/932; 493/933; 493/938; 224/148; 239/153; 239/154

[58] Field of Search ..... 224/148; 239/153, 154; 493/189, 199, 200, 213, 214, 217, 223, 932, 933, 938, 939

[56] References Cited

U.S. PATENT DOCUMENTS

| | | | |
|---|---|---|---|
| 1,959,782 | 5/1934 | Fenwick | 239/154 |
| 2,013,358 | 9/1935 | Osborne | 239/153 |
| 2,044,687 | 6/1936 | Hatten | 239/154 |
| 2,162,057 | 6/1939 | Brandt et al. | 239/154 |
| 3,244,576 | 4/1966 | Swartz | 493/217 |
| 3,630,798 | 12/1971 | Wicks | 493/217 |
| 4,423,829 | 1/1984 | Katz | 493/213 |
| 4,688,643 | 8/1987 | Carter et al. | 224/148 |

FOREIGN PATENT DOCUMENTS

| | | | |
|---|---|---|---|
| 3641337 | 6/1988 | Fed. Rep. of Germany | 493/933 |
| 2033832 | 5/1980 | United Kingdom | 493/933 |

OTHER PUBLICATIONS

United States Department of Agriculture, Forest Service, Specification 5100, 257a; Oct., 1981.

*Primary Examiner*—William E. Terrell
*Attorney, Agent, or Firm*—Juettner Pyle Lloyd & Verbeck

[57] ABSTRACT

A portable water reservoir to be worn by a firefighter to provide a supply of water for use in extinguishing fires, e.g., the remnants of a forest or brushland fire, comprises a garment like body formed of an inner ply of flexible sheet material having a high resistance to rupture, puncture and delamination, and capable of being welded to itself such that the weld likewise has high resistance to rupture and delamination, the inner ply being doubled and welded to itself continuously along its free edges in a continuous wide weld to define therein a water-tight reservoir capable of holding several gallons of water; and an outer ply of flexible sheet material having high tensile and tear strength, shape retention, and resistance to heat, flame and hydrostatic pressure; the outer ply overlying and completely encompassing the inner ply and the reservoir defined thereby and being mechanically attached, preferably stitched or sewn, at its free marginal edges to and continuously along and solely within the continuous wide weld at the free edges of the inner ply, so that the integrity of the reservoir is preserved and the outer ply firmly supports and imparts strength and shape retention to the inner ply.

10 Claims, 4 Drawing Sheets

FIG. 1
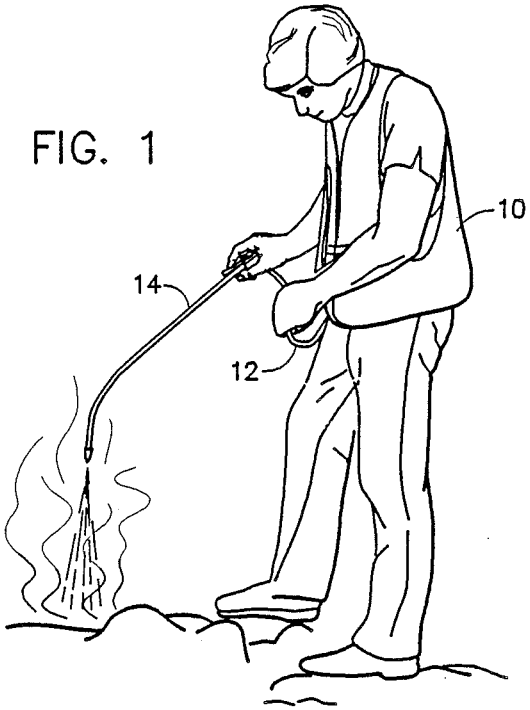
FIG. 2
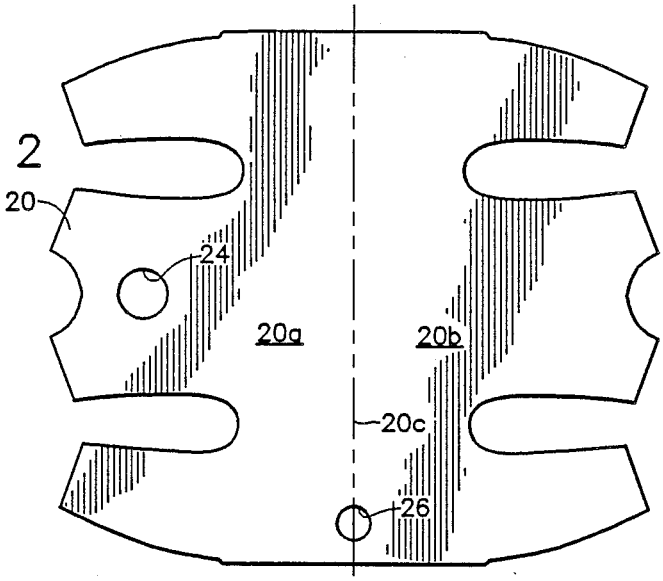
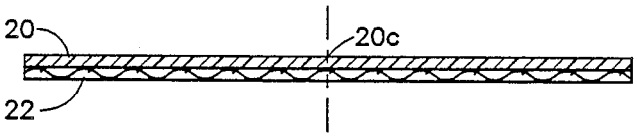
FIG. 3

FIG. 4
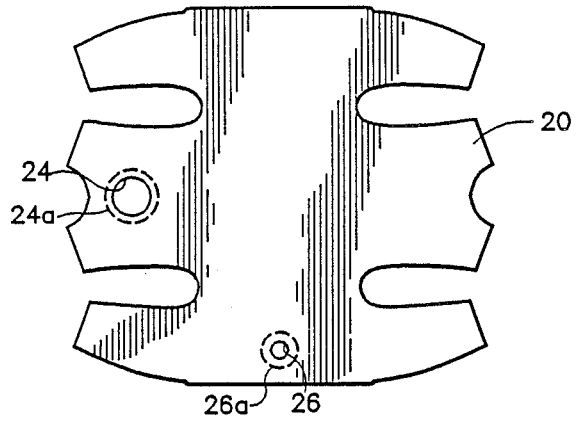
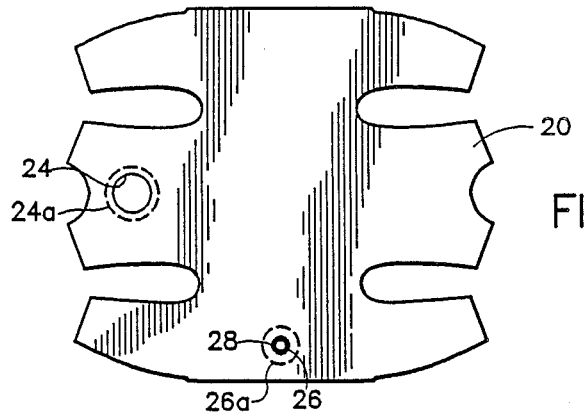
FIG. 5
FIG. 6
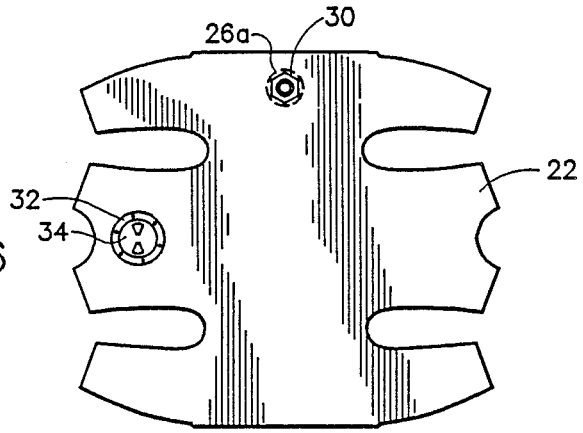

FIG. 9
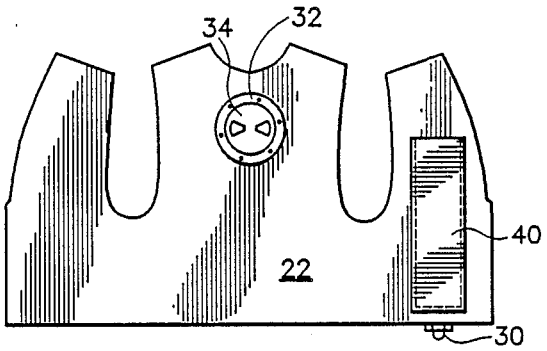
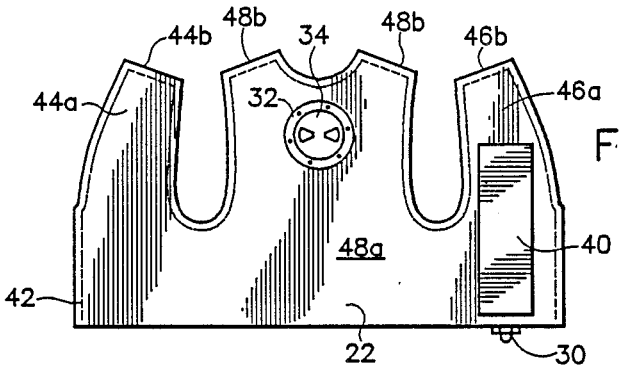
FIG. 10
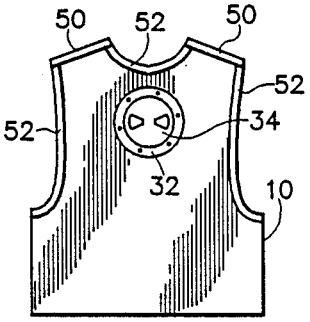
FIG. 11
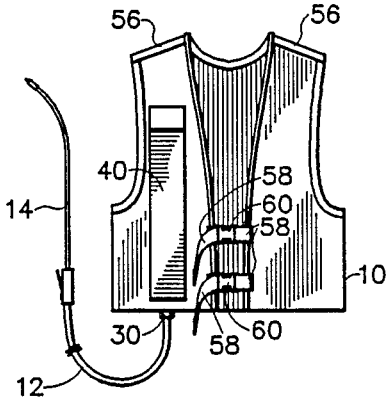
FIG. 12

FIREFIGHTER'S PORTABLE WATER RESERVOIR AND METHOD OF MAKING THE SAME

TECHNICAL FIELD

The present invention relates to water reservoirs to be worn by firefighters to provide a portable supply of water for use in extinguishing fires and/or the remnants of fires which have been substantially but not entirely struck out.

BACKGROUND ART

When fires are just about burned or struck out, there are usually smoldering embers remaining that must be extinguished to insure against a subsequent flare-up and resumption of the fire. In many instances, particularly in the case of forest fires, sources of water or other fire-fighting liquids cannot effectively or conveniently be delivered to the locale by hose. In such cases, a portable supply of water must be carried to the scene and sprayed onto the smoldering embers to extinguish the same.

Portable pressure tanks or pump tanks with associated sprayers could be hand carried to the scene, but the same are bulky, heavy, and unwieldy, or of inadequate capacity, and require use of the firefighter's hands to carry the tank rather than leaving his or her hands free for performance of fire extinguishing activities. The U.S. Department of Agriculture Forest Service has issued specifications for backpack tanks to be used with hand-operated pumps for fighting forest and brushland fires. The tanks are made of metal, rigid plastic, or synthetic elastomer-coated fabric and are provided with straps for both hand carrying and backpacking. A filler opening is provided in the upper part of the tank to accommodate filling of the same with a firefighting liquid (herein referred to generically as 'water'), and an outlet fitting is provided in the lower regions of the tank to accommodate gravity discharge of the water to a hand-operated sprayer pump o water wand. The outlet is preferably provided with a quick-connect coupler for facilitating rapid connection and disconnection of a hose that couples the pump or wand to the reservoir. When carried as a backpack, the tank allows hands free movement of the firefighter in the field.

It has also been proposed to provide a water reservoir in the form of a vest which can be worn by the firefighter to enable him or her to carry several gallons of water easily and conveniently into the field; the vest, like the backpack tank, including a upper filler fitting and a lower outlet fitting for detachable connection of a water wand or sprayer pump. Because the reservoir is formed as a vest, the firefighter's legs, arms and hands are free of encumbrance to facilitate the performance of firefighting functions.

The vest and fabric backpack tank offer significant advantages over the rigid tanks. They are flexible and collapsible; before filling, they can be transported in bulk quantities in their collapsed state to the scene of a fire; after filling, they are more conformable to the firefighter's body and are less cumbersome; as the water is drained from them, they collapse and become even less cumbersome; and they hold more water. Rigid tanks will conventionally hold about 3.9 to 4.3 gallons of water, while a fabric backpack of the same size will hold 4.9 to 5.5 gallons.

A water vest, on the other hand, will hold approximately 8 gallons of water, since the reservoir space encompasses the entire torso of the firefighter's body from about the waist to about the level of the armpits. The weight, totaling about 70 pounds, is evenly distributed over and carried by the firefighter's shoulders as well as the back, so that the additional water is made available without discomfort to the operator and without impairing the operator's freedom of movement. Also, the outlet fitting and quick disconnect coupler for the hose of the pump can be located at the front of the user's body rather than the back, where it is exposed for far more convenient access.

The concept of the water vest has been well received by firefighters, but all of its promise has not heretofore come to fruition. Too many of the vests previously proposed have leaked, have been easily punctured by projecting objects such as tree branches, and have burst under conditions of use. In fighting forest fires, the vests are frequently filled with water at the nearest available but nevertheless remote supply and then trucked to the area or areas where the water is needed. As the truck drives through such an area, and in haste to bring the fire under control, the filled vests are hurled off the truck onto the side of the road to be picked up by the firefighters as they are needed. Regretably, due mainly to delamination upon impact of the heat sealed margins of the elastomer coated fabric, many of the vests burst when they hit the ground, thereby wasting the vest, the much needed water, and all the time, effort and expense that went into bringing the water to the fire. Essentially the same is true of the fabric backpack tanks previously proposed.

It is the object of the present invention to provide improved, flexible and collapsible, portable water reservoirs to be worn by firefighters that will overcome all of the deficiencies of the prior art reservoirs and provide reliable sources of water substantially irrespective of the physical abuse to which the reservoirs may be subjected in use.

SUMMARY OF THE INVENTION

In accordance with the present invention, firefighters' water reservoirs are comprised of an integral, one-piece inner ply of water impervious unsupported vinyl or like sheet material which is sonically welded together around all of its free edges to define the boundaries of a garment like reservoir, e.g., a vest or the like, and an outer ply of supported (reinforced) vinyl or the like which completely covers the inner ply and is stitched or otherwise mechanically secured to the sonically welded boundary defining edges of the inner ply solely within the areas of the sonic welds. Sonic welds are also provided between the two plys around a filler opening in the upper portion of the rear wall of the garment and around an outlet opening adjacent the lower boundary of the garment. A large mouth fill fitting is sealingly secured to the garment within the filler opening, and an outlet fitting is sealingly secured within the outlet opening.

Except for the openings in the two fittings, the inner ply comprises a hermetically sealed water reservoir of the desired capacity that is very highly resistant to delamination, puncture and rupture; the very forces that have heretofore caused water vests and fabric backpacks to fail in use. The outer ply, which except for its mechanical (not heat sealed) attachment to the inner ply would be subject to failure due to delamination, puncture and/or rupture upon impact, imparts physical strength, shape retention, and wear and tear resistance to the composite structure.

In fully loaded impact resistance tests, the reservoir of the invention has far exceeded the requirements of specifying bodies for firefighters' water reservoirs. One test specified by the U.S. Forest Service requires the filled reservoir to be dropped on each of its corners from a height of at least 42 inches onto a concrete slab, and then inspected for leaks. The filled reservoir of the invention, fabricated as a vest carrying about eight gallons (70 pounds) of water has been dropped onto concrete from a height of 30 feet with no signs of rupture, leakage, or other damage.

The invention thus provides a vastly improved firefighter's portable water reservoir overcoming the disadvantages and failures of reservoirs previously used.

The invention also provides a novel and highly efficient method for making the improved reservoir above described.

Other features and advantages of the invention will become apparent from the following detailed description, considered in conjunction with the accompanying drawings.

BRIEF DESCRIPTION OF THE DRAWINGS

FIG. 1 is an illustration showing how a firefighter would wear and use a water reservoir vest made in accordance with the invention;

FIG. 2 is a plan view showing the outline of the two superimposed plys of sheet material that are used to make a water reservoir vest in accordance with the preferred embodiment of the invention, the view showing the interior surface of the inner ply;

FIG. 3 is a cross sectional view of the two superimposed plys of material used to make the vest, namely, an inner ply of unsupported vinyl and an outer ply of fabric reinforced vinyl;

FIGS. 4 and 5 are plan views of the interior surface of the inner ply illustrating sequential steps performed in accordance with the method of the invention to make the reservoir vest of the invention;

FIG. 6 is a plan view of the exterior surface of the outer ply illustrating the assembly of the fill and outlet fittings to the two plys of material;

FIGS. 9 and 10 are plan views of the exterior surface of the outer ply illustrating succeeding steps in the manufacture of the vest;

FIG. 11 is a view illustrating the nearly completed vest in rear elevation; and FIG. 12 is a view illustrating the completed vest in front elevation.

DETAILED DESCRIPTION

Figure 7:
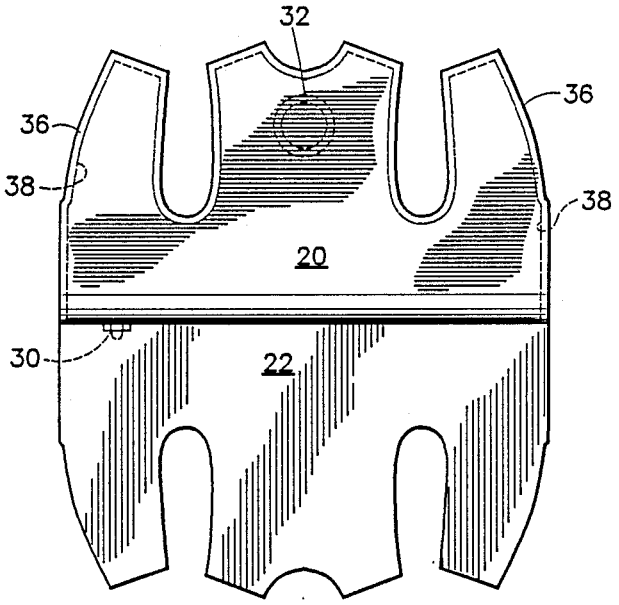
FIG. 7 is a plan view illustrating the next succeeding step in the manufacture of the vest.

The drawings illustrate the preferred method of making the preferred embodiment of the portable water reservoir of the invention, namely, a firefighter's water vest. However, it is to be understood that the water reservoir may be made in other body conformable shapes and/or other configurations, and methods for making such other shapes and/or configurations will become manifest from the following description of the preferred method of making the preferred embodiment. Also, it is to be understood that use herein of the term 'water' is intended to encompass all liquid compositions that may be used effectively and practically for firefighting purposes.

Referring to FIG. 1, the water reservoir vest of the invention, indicated generally at 10, is intended to be worn by humans in the manner that is conventional for the wearing of vests. The weight of the water in the vest will thereby be supported and comfortably and conformably carried by the shoulders and back of the user. The vest is filled with water, customarily about 8 gallons or somewhat more (approximately 70 pounds), so that when the vest is full the torso of the user is completely surrounded by water. The water is dispensed by gravity from a bottom front edge of the vest via a flexible hose 12 which is coupled to a water wand or hand-operated pump or sprayer 14 which may be controlled and manipulated by the user to extinguish smoldering embers and other incidents of a fire that is being extinguished.

Due to the fact that the reservoir is in the form of a vest, and is flexible, collapsible and conformable to the user's torso, the user's arms and legs remain free of impediments, thereby to accommodate complete freedom of movement of the firefighter in the field, even in densely forested areas.

As will appear more specifically from the subsequent description of the method of making the improved water reservoir, each reservoir is comprised preferably of an integral inner ply of water impervious unsupported vinyl and an outer ply of supported or reinforced vinyl. The inner ply is doubled upon itself and is sonically welded to itself along each of its free edges, thereby to define therein a hermetically sealed liquid container that is highly resistant to puncture, rupture and impact forces, and that is not reactive with and will retain chemical firefighting compounds. Because the inner ply is not a laminated sheet material, it is not itself subject to delamination, and the sonic welds are sufficiently strong that they likewise are not subject to rupture or delamination. The outer ply is attached mechanically, preferably sewn, to the inner ply along said sonically welded free edges, solely within the area of the sonic welds. Because of this manner of attachment, the outer ply will not become subject to delamination and the integrity of the inner ply will be preserved. The outer ply has significant tensile strength, good shape retention, and high resistance to stretching and tearing. It thereby imparts physical strength, tear resistance, and shape retention characteristics to the garment. As a consequence of the multi-ply construction, the portable water reservoir of the invention is highly resistant to and capable of sustaining all of the abuse to which the same will ultimately be subjected in the field.

When put to use in the field, the vest may be transported in bulk in a collapsed, compact and lightweight state to the scene of the fire, specifically to a location where water is available for filling them. The reservoirs are then filled with water and trucked to locales where they are needed. Due to their great resistance to impact, bursting and other damage, the water reservoirs of the invention can simply be hurled from the trucks onto the side of the road so as to preserve time and human resources under crisis conditions. Individual firefighters can then retrieve the filled reservoirs from the side of the road, simply slip one on, and proceed with their firefighting activities.

Due to the strength and tear resistance of the outer shell, the reservoirs can withstand substantial abuse and remain available for refilling and reuse time and time again.

In order to make the vest of the invention, two plys of flexible sheet material are cut to the configuration illustrated in FIG. 2. This configuration in essence is double-sized and comprises two of the layouts that a conventional tailor would use for making a vest; the two layouts or halves, as indicated at 20*a* and 20*b*, being of opposite hand and lying on opposite sides of a common center line 20*c* such that the center line will become the lower marginal edge of the vest of the invention when the sheets of material are folded in half along the line. The two sheets are of the same size and shape and, as shown in FIG. 3, are superimposed on but not secured to one another. The two sheets comprise an inner ply 20, preferably of unsupported vinyl and an outer ply 22, preferably of supported or reinforced vinyl. Other flexible plastic sheet materials may be used in production of the water reservoir of the invention provided that: (a) the inner ply is an integral, one piece sheet that is resistant to puncture, rupture and delamination and is capable of being integrally bonded to itself so that the bond likewise is not subject to delamination or rupture; and (b) the outer ply is a sturdy, wear-and-tear resistant, shape retaining fabric having high tensile strength and high resistance to heat, flame and hydrostatic pressures. Because of their ability to fullfil these specific requirements, it is presently preferred that the inner ply comprise a 22 ounce, 20 mil thick integral, one piece sheet of clear polyvinyl chloride; and that the outer ply comprise a 13 ounce file finish yellow or other brightly colored fabric, also preferably in one piece, comprised of a polyester scrim laminated between or coated with polyvinyl chloride. The latter material has been selected for the outer ply 22 because it provides high visibility, good shape retention characteristics, high tensile and tear strengths, and excellent resistance to high and low temperatures, flame, and hydrostatic pressures. An acceptable material is 'Mule-Tex' vinyl laminated polyester which passes Federal Standard #191 and California Fire Marshall flame resistance test No. F31.01.

The two plys of material 20 and 22 are provided with mating filler opening holes 24 in what will become the upper rear surface of the garment, and mating outlet opening holes 26 along the center line between the two halves of each ply such that the outlet will be located on or in the bottom margin of the garment, and in the illustrated embodiment, at the front of the garment on either the right or left-hand side thereof, preferably the right-hand side.

The two plys of material are welded together about the holes 24 and 26, preferably with a continuous circular weld as indicated by the dotted lines 24*a* and 26*a* in FIG. 4. All of the welding on the garment is preferably performed by means of radio frequency heat sealing, e.g., with a 'Thermatron' sealer, thereby to produce what is known as a sonic weld. Because of the tugging forces that will be exerted thereon via the hose 12 in use of the garment, the weld 26*a* around the outlet holes 26 is an extra heavy weld, preferably a one-quarter inch wide weld.

Referring to FIG. 5, a sealing gasket 28, preferably a silicone grommet, is next welded to both plys of material within the outlet holes 26 to provide means for effective and leakproof sealed mounting of an outlet fitting 30 (FIG. 6) within the outlet opening formed by the holes 26. The outlet fitting 30 is preferably formed brass and configured for the attachment thereto of a quick connect hose coupler. The fitting is secured to the two sheets or plys of material by means of a nut threaded onto the brass fitting at the inner side of the inner ply, the nut trapping the silicone seal 28 between itself and a flange on the fitting 30 thereby to seal the fitting to the grommet and the two sheets or plys of material.

Also as illustrated in FIG. 6, a fill fitting 32, having a removable closure cap 34, is securely and sealingly mounted within the filler opening holes 24. The fitting 32 is preferably a marine type of fitting having a large mouth, e.g., 4 inch diameter, screw threaded flanged opening therethrough. The flange of the fitting is abutted against the outer surface of the outer ply 22 and a securing ring (not shown) is abutted against the interior surface of the inner ply 20, preferably with sealing gaskets and a sealing compound interposed between the flange and ring and the adjacent sheet surfaces against which the same are abutted. The flange and the ring are then drawn tightly together by a plurality of circumferentially spaced fasteners with the welded portions of the two plys of material firmly and sealingly clamped therebetween.

The removable closure 34 is preferably attached to the body of the fitting 32 by a short length of chain or the like so that the closure will not become disassociated from the garment during filling of the garment with water. A filter formed of mosquito netting or the like is also sealed within the mouth of the fitting to prevent entry, during filling from a lake or the like, of leaves and other debris that might clog the outlet fitting 30. The large mouthed fill fitting 32 thus facilitates very rapid filling of the garment with debris-free water, even under the most difficult of circumstances.

Following assembly of the outlet and fill fittings 30 and 32, the inner ply 20 is folded in half as illustrated in FIG. 7 (i.e., with the half 20*b* overlying the half 20*a*), and the two halves are sonically welded together continuously along their free edges throughout an area 36 lying between the free edges and the dotted line 38 shown in FIG. 7. The weld 36, as further illustrated in FIG. 8, is a continuous, wide, flat weld, preferably at least about 1 inch wide, so that the two halves of the inner ply are intimately and integrally bonded together along their boundary edges to form a hermetically sealed water reservoir.

A pocket 40 for conveniently carrying a water wand or hand-operated sprayer pump is then stitched to the outer surface of the outer ply 22 before the outer ply is folded in half and without perforating or otherwise contacting the inner ply. The pocket 40 is preferably located so that it will be immediately above the water outlet fitting 30 when the outer ply is folded in half, as is illustrated in FIG. 9.

Figure 8:
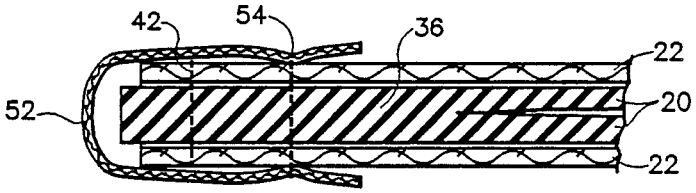
FIG. 8 is an enlarged cross sectional view illustrating the manner in which the two plys of material are assembled and secured together along their free edges.

After the outer ply 22 is folded in half, its free edges are mechanically attached, preferably basted with strong thread, to the sonically welded edges of the inner ply 20 solely within the sonically welded areas 36 of the inner ply, as indicated by the dotted line 42 in FIGS. 8 and 10. This retains the two plys in folded and assembled relation to facilitate final stitching of the garment.

The two flaps or outboard panels 44*a* and 46*a* (FIG. 10) that will form the front of the vest are then folded over the panel 48*a* that will form the rear of the vest, and the top edge 44*b* and 46*b* of each side panel is then mechanically attached, preferably basted, to the adjacent top edge portion 48*b* of the back or rear panel 48*a* to form the shoulders of the vest; the basting again being effected solely within the sonically welded area 36 of the inner ply 20. The shoulders of the vest are then finished by securely attaching, preferably stitching together the overlying pairs of the joined top edges 44*b* –48*b* and 46*b* –48*b*. Before stitching, the joined edges are preferably reinforced with a strong, fabric reinforcing tape 50 (FIG. 11), such as nylon tape, which is securely stitched, all in one stitching step, over both the inner and outer surfaces of each pair of joined edges.

The remainder of the sonically welded free edges of the vest, i.e., the edges defining the arm holes, the neck and the inner edges of the front flaps 44*a* and 46*a*, are then finished by folding reinforcing tape 52, preferably nylon fabric tape, over each of the free edges and mechanically attaching, preferably securely stitching together, with stitching 54, the two layers of tape 52, the two layers of the outer ply 22, and the sonically welded margins 36 of the inner ply 20, all as illustrated in enlarged detail in FIG. 8. All stitching is carefully controlled to occur solely within the sonically welded area 36 of the inner ply, thereby to preserve the integrity of the water reservoir.

The garment may then be completed, as shown in FIG. 12, by stitching sturdy carrying straps 56 in the form of epaulettes to the inner and outer edges of the shoulders of the vest, above the upper seam reinforcing tapes 50, and by stitching onto mating portions of the inner edges of the front flaps the straps 58 for mating pairs of closure buckles 60.

The straps 56 and 58 are preferably of sturdy polypropylene or nylon webbing, and the buckles 60 are preferably quick connect/quick disconnect buckles formed of impact and heat resistant plastic.

In the finished product, the outer ply supports the inner ply and water reservoir from the top, side and bottom edges or margins thereof to impart strength, wear and tear resistance, and shape retention to the reservoir. The outer ply is not subject to rupture or delamination, because reliance is not placed on heat sealing of the outer ply, but rather on mechanical attachment of the outer ply to the sonic welds on the inner ply. Also, any object puncturing the outer ply will not have an adverse effect on the inner ply, because the inner ply is separate from and movable relative to the outer ply except at its welded edges and adjacent the fill and outlet fittings. Consequently, the inner ply, even when filled with water, is free to move relative to the outer ply over the majority of the surface area thereof, thereby to resist puncturing forces that can penetrate the outer ply.

The vest 10 is thus produced very efficiently and economically in accordance with the method of the invention to provide a vastly improved portable water reservoir for firefighters, and in particular, a wearable water reservoir that is flexible and collapsible, expandable and contractable; that is conformable to the torso of the wearer, leaving the wearer's arms and legs free from impediment; that will withstand the rigorous abuse to which the reservoir will be subjected in use; that will not under normal conditions leak, puncture, rupture or burst; and that is capable of sustained and repeated use over a long useful lifetime. The objects and advantages of the invention have thus been shown to be attained in an economical, practical and facile manner.

Other forms of water reservoir having the described advantages, and appropriate method steps for fabricating the same, should now be manifest to those of reasonable skill in the art.

Thus, while a preferred water reservoir and the preferred method of making the same have been herein illustrated and described, it will be appreciated that various changes, rearrangements and modifications may be made therein without departing from the scope of the invention, as defined by the appended claims.

What is claimed is:

1. A method of making a firefighter's portable water reservoir comprising the steps of providing a first ply of water impervious flexible sheet material highly resistant to delamination, puncture and rupture and capable of being integrally welded to itself such that the weld likewise is highly resistant to delamination and rupture;

providing a second ply of reinforced flexible sheet material having high tear and tensile strength, shape retention, and resistance to heat, flame and hydrostatic pressure;

cutting each of said plys to a configuration comprising a matched pair of layouts of a garment-like body portion conformable to a portion of a firefighter's body, each pair of layouts being of opposite hand and integrally joined together along a center line which defines the bottom boundary of the garment like body portion;

superimposing one ply of material on the other ply of material in mutually aligned relationship;

cutting aligned outlet openings through the two plys of material along their respective center lines;

cutting aligned filler openings through the two plys of material in an area thereof that will comprise an upper outer wall portion of the garment-like body portion;

securing an outlet fitting in the aligned outlet openings in sealed relationship with portions of both plys of material surrounding the respective outlet openings;

securing a fill fitting in the aligned filler openings in sealed relationship with portions of both plys of material surrounding the respective filler openings;

folding the first ply of material upon itself along the center line thereof and aligning the free edges of the two layouts thereof with one another;

welding the free edges of the two layouts of the first ply to one another in a continuous wide weld;

folding the second ply of material along the center line thereof to enclose the first ply within the second ply and aligning the free edges of the two layouts of the second ply with one another and the welded edges of the first ply; and attaching the free edges of both layouts of the second ply to the welded edges of the first ply substantially continuously along and solely within the continuous wide weld.

2. The method of claim 1 including the step of welding the two superimposed plys of material together in areas thereof surrounding at least one pair of the aligned openings therein prior to the step of securing the respective fitting in the openings.

3. The method of claim 1 including the step of welding a fitting seal within at least one pair of the aligned openings in the two superimposed plys of material prior to the step of securing the respective fitting in the openings.

4. The method of claim 1 including the steps of aligning reinforcing tape with the opposite exterior surfaces of the aligned free edges of the two layouts of the folded second ply and the welded edges of the folded first ply and attaching the two layers of reinforcing tape and the free edges of the two layouts of the second ply to the welded edges of the first ply solely within the area of the continuous wide weld.

5. The method of claim 1 including the steps of providing carrying straps for the reservoir and attaching the straps at their opposite ends to the aligned free edges of the two layouts of the folded second ply and the welded edges of the folded first ply solely within the area of the continuous wide weld at selected locations on the garment-like body portion.

6. A method of making a portable water reservoir vest for firefighters comprising the steps of providing an integral one piece first ply of water impervious flexible sheet material highly resistant to delamination, puncture and rupture and capable of being integrally welded to itself such that the weld likewise is highly resistant to delamination and rupture;

providing a second ply of reinforced flexible sheet material having high tear and tensile strength, shape retention, and resistance to heat, flame and hydrostatic pressure;

cutting each of said plys to a configuration comprising a matched pair of layouts for a vest; each layout including a back portion, a pair of front flap portions and mating shoulder portions at the upper edges of said back and front flap portions; each pair of layouts being of opposite hand an integrally joined together along a center line which defines the bottom boundary of the back and front flap portions of the vest;

superimposing one ply of material on the other ply of material in alignment with one another;

cutting aligned outlet openings through the two plys of material along their respective center lines at the bottom boundary of one of the aligned front flap portions thereof;

cutting aligned filler openings through the back portions of the two plys of material in an area thereof that will comprise an upper outer wall portion of the back of the vest;

securing an outlet fitting in the aligned outlet openings in sealed relationship with portions of both plys of material surrounding the respective outlet openings;

securing a fill fitting in the aligned filler openings in sealed relationship with portions of both plys of material surrounding the respective filler openings;

folding the first ply of material upon itself along the center line thereof and aligning the free edges of the two layouts thereof with one another;

welding the free edges of the two layouts of the first ply to one another in a continuous wide weld;

folding the second ply of material along the center line thereof to enclose the first ply within the second ply and aligning the free edges of the two layouts of the second ply with one another and the welded free edges of the first ply;

mechanically attaching the free edges of both layouts of the second ply to the opposite sides of the welded edges of the first ply substantially continuously along and solely within the area of the continuous wide weld;

folding the front flap portions of the vest over the back portion and bringing the mating shoulder portions thereof into alignment with one another; and mechanically attaching the mating shoulder portions together along and solely within the wide weld at the welded upper edges of the first ply.

7. The method of claim 6 including the steps of aligning reinforcing tape with the opposite surfaces of the aligned shoulder portions and mechanically attaching the two layers of tape and the aligned mating shoulder portions of the two layouts of the second ply to the aligned mating shoulder portions of the welded upper edges of the two layouts of the first ply.

8. The method of claim 6 including the steps of folding reinforcing tape over the aligned free edges of the layouts of the first and second plys that define the armholes, neck and inner edges of the front flaps of the vest, and mechanically attaching the two layers of reinforcing tape and the aligned free edges of the two layouts of the second ply to the aligned welded edges of the first ply substantially continuously along and solely within the continuous wide weld.

9. The method of claim 6 including the steps of providing carrying straps for the vest in the form of epaulettes overlying the upper outer surfaces of the mating and attached shoulder portions of the vest; and mechanically attaching the carrying straps at their opposite ends to the free edges of the two layouts of the second ply and the welded edges of the first ply that define the neck and the upper margin of the respective armholes of the vest.

10. The method of claim 6 including the steps of providing buckle straps for the front flaps of the vest and mechanically attaching the straps to adjacent aligned inner edge portions of the front flaps solely within the area of the continuous wide welds at said edges.

* * * * *